United States Patent [19]

Marco et al.

[11] 4,235,735

[45] Nov. 25, 1980

[54] LAUNDRY DETERGENT CONTAINING CELLULOSE ACETATE ANTI-REDEPOSITION AGENT

[75] Inventors: Francis W. Marco, Pauline; Philip G. Harris, Spartanburg, both of S.C.

[73] Assignee: Milliken Research Corporation, Spartanburg, S.C.

[21] Appl. No.: 61,632

[22] Filed: Jul. 30, 1979

[51] Int. Cl.[2] ..... C11D 3/22; C11D 3/02

[52] U.S. Cl. ..... 252/174.18; 252/135; 252/174.23; 252/539; 252/DIG. 2; 252/15

[58] Field of Search ..... 8/18; 252/8.6, 89.1, 252/174.18, 174.23, 539, DIG. 2, 15, 135; 536/69

[56] References Cited

U.S. PATENT DOCUMENTS

| | | | |
|---|---|---|---|
| 2,566,501 | 9/1951 | Smith et al. | 252/539 |
| 2,994,665 | 8/1961 | Reich et al. | 252/539 X |
| 3,144,412 | 8/1964 | Inamorato | 252/539 |
| 3,523,088 | 8/1970 | Dean et al. | 252/539 |
| 4,127,495 | 11/1978 | Swinson | 252/558 X |
| 4,164,392 | 8/1979 | Hauser | 8/18 R |
| 4,168,954 | 9/1979 | Marco | 8/18 R |
| 4,174,305 | 11/1979 | Burns et al. | 252/545 |

FOREIGN PATENT DOCUMENTS

| | | | |
|---|---|---|---|
| 1122658 | 1/1962 | Fed. Rep. of Germany | 252/174.18 |

*Primary Examiner*—P. E. Willis, Jr.

*Attorney, Agent, or Firm*—H. William Petry; Terry T. Moyer

[57] ABSTRACT

A detergent composition is provided which contains a detergent and a cellulose acetate polymeric anti-redeposition agent having a degree of substitution of the acetyl moiety of from about 0.5 to about 2.3. The cellulose acetate polymeric anti-redeposition agent may be represented by the formula

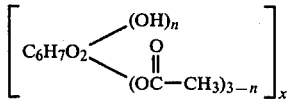

wherein x is an integer of at least about 25, n is about 2.5 to about 0.7, and the expression 3−n is the degree of substitution of the acetyl moiety.

7 Claims, No Drawings

LAUNDRY DETERGENT CONTAINING CELLULOSE ACETATE ANTI-REDEPOSITION AGENT

This invention relates to detergent compositions and more particularly to detergent compositions which contain a cellulose acetate polymeric anti-redeposition agent.

Any laundry detergent, whether liquid or powdered, desirably should not only remove soil from clothing but should also prevent soil which has been removed and suspended in the washing solution from redepositing onto the surface of the fabric as the wash water is removed. With powdered detergents, carboxymethylcellulose has been widely used as an anti-redeposition agent. A large number of commercially available detergent compositions, either for household or industrial use contain carboxymethylcellulose (herein CMC), and the anti-redeposition efficacy of CMC is well known. It is also well known, however, that such efficacy is achieved generally only with cotton fabrics and that CMC has little or no anti-redeposition effect when the material to be washed is a synthetic fabric, such as a polyester or a synthetic-cotton blend. Cellulose ethers have also been suggested for use as anti-redeposition agents in detergent compositions; and although such compounds generally have good soil release properties they are unsatisfactory in preventing redeposition of particulate soil onto fabrics during the washing cycle.

It has been suggested recently that textile materials formed of polyester or nylon fibers may be provided with improved durable soil release characteristics by application to the textile material of a water-soluble cellulose acetate polymeric constituent. In this regard, U.S. Pat. No. 4,162,954, Francis W. Marco, discloses a method for imparting durable soil release and moisture transport characteristics to a textile material formed of polyester or nylon fibers by applying to the textile material a water-soluble cellulose acetate polymeric constituent having a degree of substitution of the acetyl moiety of from about 0.6 to about 0.9. U.S. Pat. No. 4,164,392, Peter J. Hauser and Francis W. Marco, discloses a method for imparting durable soil release and moisture transport characteristics to a textile material formed of polyester or nylon fibers by application to the textile material of a water-insoluble cellulose acetate polymeric constituent having a degree of substitution of the acetyl moiety of from about 0.9 to about 2.3. According to these techniques for imparting durable soil release and moisture transport characteristics to a textile material, the cellulose acetate polymeric constituent may be applied to the fabric from a pad bath containing the polymeric constituent, by exhaustion techniques during the dyeing of the textile material or as a spray. Neither disclosure, however, suggests that the inclusion of a cellulose acetate polymeric constituent in a detergent composition might advantageously serve to minimize or prevent the redeposition of soil from the wash water onto the fabric being laundered. In addition there has been no suggestion that fabrics, particularly polyester- and nylon-containing fabrics, laundered in such detergent compositions containing a cellulose acetate polymeric anti-redeposition agent would be imparted with excellent soil release and moisture transport characteristics.

It, therefore, would be highly desirable to provide a detergent composition which is effective to minimize or prevent redeposition of soil from the wash water onto synthetic fabrics or synthetic-cotton blends, e.g., polyester such as Dacron ® and Kodel ®, polyamides such as nylon, polyvinyl derivatives such as Orlon ®, Creslan ® or Dynel ®; and cellulose ester fibers such as Arnel ®, because of the current widespread use of such materials. The problem is not a simple one, however, because anti-redeposition agents which are effective with regard to synthetic fabrics or even synthetic-cotton blends may have an averse anti-redeposition effect on cotton. Moreover, as a practical matter, the ordinary load of clothes to be washed consists of a mixture of cotton fabrics, synthetic fabrics and synthetic-cotton blends. Therefore, an anti-redeposition agent effective with both cotton and synthetic fabrics would be highly desirable, but has so far been difficult to achieve.

Accordingly, the present invention provides a detergent composition which is effective to minimize or prevent the redeposition of soil on synthetic fabrics, such as polyesters, as well as synthetic cotton blends, e.g., polyester-cotton and even cotton fabrics. In addition, the detergent composition of the present invention also functions to improve soil removal from laundered fabrics, to allow synthetic fabrics to pick up optical brighteners present in the detergent composition, and it further functions to impart soil release and moisture transport characteristics to fabrics, particularly polyester- and nylon-containing fabrics, laundered in the detergent composition.

The detergent composition of the present invention contains in addition to an effective amount of a detergent a cellulose acetate polymeric anti-redeposition agent having a degree of substitution of the acetyl moiety of from about 0.5 to about 2.3. The cellulose acetate polymeric anti-redeposition agent present in the detergent composition of the present invention may be represented by the formula:

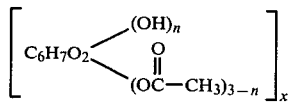

wherein x is an integer of at least about 25, n is from about 2.5 to about 0.7, and the expression 3−n is the degree of substitution of the acetyl moiety. The $C_6H_7O_2$ moiety of the above-described cellulose acetate polymeric constituent is to be understood to be a representation of a portion of the repeating cellulose unit which has the following structural configuration:

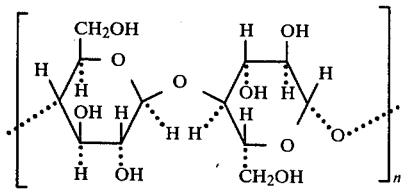

Although any cellulose acetate polymeric constituent characterized as above will provide good anti-redeposition properties in a detergent composition, especially desirable results can be obtained when the cellulose acetate polymeric anti-redeposition agent employed is water-insoluble and has a degree of substitution of the acetyl moiety of from above about 0.9 to about 2.3.

The cellulose acetate polymeric constituent employed in the detergent composition should be sufficient to provide anti-redeposition properties in a laundered fabric during a standard wash cycle. Generally such results can be accomplished when at least about 0.2 percent by weight of the anti-redeposition agent is provided in the detergent composition. Generally good results may be achieved where from about 1 percent to about 3 percent by weight of the anti-redeposition agent is provided in the detergent composition.

The detergent compositions of the present invention may include an effective amount of an organic synthetic detergent component that may be anionic, nonionic, ampholytic, zwitterionic or mixtures thereof, although anionic and nonionic detergents are preferred. An effective amount of detergent may vary widely depending upon the specific detergent, i.e., surfactant selected, the presence of "builders" in the composition, as well as other ingredients that may be present in the composition. As used herein, the phrase "effective amount" may be defined to include those amounts of detergent which are sufficient to remove and suspend in the wash water substantial portions of soil and other unwanted matter from laundry during a standard commercial or home washing cycle. Generally, an effective amount of detergent component in a detergent composition will be from about 5 percent to about 90 percent by weight, preferably from about 15 percent to about 60 percent by weight.

Among the preferred anionic detergents that may be used are the sodium alkyl sulfonates, sodium alkyl sulfates, sodium alkyl aryl sulfonates, sodium salts of sulfated and sulfonated alkyl amides, sodium salts of sulfated and sulfonated esters, and the sodium salts of esters of polyhydric alcohol-sulfonates; however, any suitable anionic detergent may be used in the present composition. Examples of suitable anionic detergents are sodium long-chain hydrocarbon sulfonate (Alkanol 189-S, DuPont, Wilmington, Del.), sodium lauryl sulfate (Dupanol C, DuPont, Wilmington, Del.), sodium dodecylbenzene sulfonate (Ultrawet K, Atlantic Refining Company, Philadelphia, Penn.), sulfonated fatty amide (Pyrotex, Standard Chemical Products, Inc., Hoboken, N.J.), sulfonated fatty ester (Nopco 2272-R, Nopco Chemical Company, Newark, N.J.), sodium 1-(N-methyl-N-oleoyl-amino) ethyl sulfonate (Igepon T, General Aniline and Film Corporation, New York, N.Y.).

Any suitable nonionic detergent may also be used in the preferred detergent compositions of the present invention. Among the nonionic detergents that may be used in the preferred detergent compositions are condensation products of lower alkylene oxides, for example, ethylene oxide, propylene oxide, butylene oxides, and mixtures thereof, with compounds having at least one actice hydrogen atom such as fatty acids, rosin acids, tall oil acids, alcohols, phenols, and alkyl phenols. Generally, these condensation products will have a mole ratio of alkylene oxide to the active hydrogen component of from about 8 to about 25 respectively. Examples of suitable nonionic detergents are dodecylphenol condensed with 15 moles of ethylene oxide; oleyl alcohol condensed with 15 moles of ethylene oxide, rosin acids condensed with 20 moles ethylene oxide, dodecanol condensed with 4 moles of propylene oxide plus 8 moles of ethylene oxide. Examples of commercially available nonionic detergents suitable for use according to the present invention are Renex 679 and Renex 690 (Atlas Chemical Industries, Inc., Wilmington, Del.), Tergitol 15-S-9 (Union Carbide Company) and Standamul 18 (Standard Chemical Products). Other types of nonionic detergents wherein the hydrophilic portion of the compound is supplied by polyhydric alcohols such as glycerol, sorbitol, mannitol, ethylene glycol, propylene glycol, erythritol and mixtures thereof may also be used in the present detergent composition.

The detergent compositions of the present invention may be either built detergent compositions or unbuilt compositions. Typical built detergent compositions of the present invention may contain in addition to the anti-redeposition agent other essential components including a detergent and a detergent builder. These built compositions may be prepared in liquid or solid form. The "builders" which may be incorporated in the detergent compositions of the present invention may be any of those which are generally used in known built detergent products. "Builders" in detergent compositions generally serve to enhance the activity of the detergent component. For example, Zeolite, Borax, sodium carbonate, sodium tripolyphosphate, sodium metasilicate, sodium bi-carbonate, sodium phosphate and tetrasodium pyrophosphate are commonly used as detergent builders and are suitable for inclusion in the products of the present invention. As mentioned above the detergent component of the detergent composition of the present invention should be present in the composition in an effective amount. Thus, the solid, e.g., granular or flake, compositions may contain from about 5 percent to about 50 percent by weight, preferably from about 10 percent to about 25 percent by weight of a detergent component and from about 90 percent by weight to about 50 percent by weight, preferably from about 85 percent to 60 percent by weight, of a builder component, e.g., water-soluble inorganic alkaline builder salts, organic sequestrant builder salts, or mixtures thereof. The built liquid compositions generally may contain from about 5 percent to about 40 percent, preferably from about 10% to about 25% by weight detergent and from about 90 percent to about 55 percent by weight, preferably 85 percent to 70 percent by weight, of a water-soluble inorganic alkaline builder salt or organic sequestrant builder salt or mixtures thereof, in a suitable liquid vehicle, e.g., water, alcohol or mixtures thereof. The liquid built compositions preferably have a pH range of from about 9 to about 12, as do the solid built compositions when dissolved in aqueous media. Other additives such as perfumes, optical brighteners, dyes and bacteriostats as well as other anti-redeposition agents such as, for instance, carboxymethyl cellulose, can also be included in both the solid built and liquid built detergent systems.

Because the presence of certain builders may be undesirable for environmental reasons associated with the disposal of the detergent after use, there has been a trend in detergents away from the so-called "built detergents" to non-built systems. In order to retain the high detergency level of the built systems, non-built systems generally replace the builder (normally a phosphate) with a higher concentration of the detergent component. Typical non-built liquid detergents of the present invention may include in addition to an effective amount of the cellulose acetate polymeric anti-redeposition agent an aqueous solution of a mixture comprising about 30 to 40 percent by weight of a nonionic detergent and 10 to 15 percent by weight of an anionic detergent. As in the built systems, other additives such as perfumes, additives to solubilize the surfactants, optical brighteners, dyes, and bacteriostats can also be included. Ethanol may also be included for the purpose of reducing the viscosity of the detergent for ease of pouring and to assure solubility of the nonionic surfactant. Ethanolamines are often employed to ensure alkalinity of the detergent. The most commonly used nonionic detergent in liquid non-built detergent systems are linear alkyl phenols and fatty alcohols which have been ethoxylated to contain from about 40 to 70 percent by weight of ethylene oxide. The alkyl group on the substituted phenol or the fatty alcohol can contain from about 10 to 18 carbon atoms. Anionic detergents commonly used are linear-alkylbenzene sulfonates, fatty alcohol sulfates, and alkyl sulfonates. The alkyl group may contain from about 10 to 18 carbon atoms. The alkyl group of the alkyl sulfonates may be saturated or unsaturated and straight or branched chain.

In order to more fully describe the subject invention, the following examples are given. However, the examples are for illustrative purposes only and are not to be construed as unduly limiting the scope of the appended claims. In the examples, unless otherwise indicated, all percentages are by weight.

EXAMPLE 1

A piece of white 100% texturized polyester fabric was washed in a standard washing machine containing 20 gallons of wash water in a standard detergent having the following composition:

14.0% Linear Alkyl Sulfonate (sodium salt)
2.3% Alcohol Ethoxylate
2.5% High Molecular Weight Soap
48.0% Sodium Tripolyphosphate
9.7% Sodium Silicate
15.4% Sodium Sulfate
0.25% Carboxymethyl Cellulose
7.85% Moisture The amount of detergent provided in the wash was 100 grams. After washing, the fabric was rinsed and tumbled dried in the usual manner. The dried fabric was then stained with five drops of mineral oil, and five drops of used motor oil. It was then rewashed in the above composition using the same procedure used in the initial washing step. At the beginning of the wash, 0.5 grams of carbon black and 10 grams of used motor oil were added to the washing machine. After washing, the fabric was tumble-dried and rated for soil removal and soil redeposition. The results provided in the Table show that soil redeposition and soil release characteristics were poor.

EXAMPLE 2

A substantially identical piece of white 100% texturized polyester fabric to that used in Example 1 was washed using the same procedure followed in Example 1, except that one percent by weight of water-soluble cellulose acetate having a degree of substitution of the acetyl moiety of about 0.8 was added to the detergent in both the first and second washings. The results after the second washing set forth in the Table show that soil redeposition characteristics have been markedly improved, although there has been only moderate improvement in soil release tests with mineral oil and used motor oil.

EXAMPLE 3

A substantially identical piece of white 100% texturized polyester fabric to that used in Example 1 was washed using the same procedure followed in Example 1, except that one percent by weight of water-insoluble cellulose acetate having a degree of substitution of the acetyl moiety of about 1.2 was added to the detergent in both the first and second washings. The results after the second washing set forth in Table I show that soil redeposition characteristics are quite good and that soil release characteristics in both mineral oil and used motor oil tests are also very good.

EXAMPLE 4

A piece of white 100% texturized polyester fabric substantially identical to that used in Example 1 was washed using the same procedure set forth with regard to Example 1, except that the detergent composition further included 1 percent by weight hydroxybutyl methyl cellulose, a known anti-redeposition agent, in both washes. The results shown in Table I indicate that while soil release characteristics are reasonably good soil redeposition characteristics are very poor.

EXAMPLE 5

The same procedure used in Example 1 was followed except that the fabric was a multi-fabric cloth which contained Arnel, viscose, cotton, polyester, acrylic and nylon. In a separate run the same procedure was repeated except that the detergent further included 1 percent by weight cellulose acetate having a degree of substitution of the acetyl moiety of about 1.2. Again the fabric was a multi-fiber cloth which contained Arnel, viscose, cotton, polyester, acrylic and nylon.

The results showed that the soil release and soil redeposition characteristics were better on all fibers that were washed in the detergent composition which contained the cellulose acetate than they were for the same fabrics washed in the same detergent without the cellulose acetate component.

TABLE I

| | Redeposition | Soil Release | |
|---|---|---|---|
| Example | ΔL Value* | Mineral Oil | Used Motor Oil |
| 1 | 40 | Very Poor | Very Poor |
| 2 | 13 | Poor | Poor |
| 3 | 17 | Very Good | Very Good |
| 4 | 36 | Good | Good |

*ΔL value is a measure of the amount of soil redeposition that occurs during the test. It is determined by measuring the L value of the fabric on a Hunter Color Difference Meter before and after the test, and the difference is reported as the ΔL value. If the white fabric does not pick up any soil at all during the test the ΔL value will be zero. If the fabric were to turn completely black it would have a ΔL value of 100. Therefore, the higher the ΔL value the worse the soil redeposition.

What is claimed is:

1. A laundry detergent composition comprising: an organic synthetic detergent component in an amount sufficient to remove soil and other unwanted matter from laundry, and a cellulose acetate polymeric anti-redeposition agent being characterized as having a degree of substitution of the acetyl moiety of from about 0.5 to about 2.3 and represented by the formula

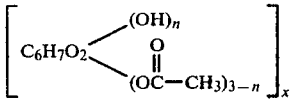

wherein x is an integer of at least about 25, n is about 2.5 to about .7, and the expression 3−n is the degree of substitution of the acetyl moiety, said anti-redeposition agent being provided in said detergent composition in an amount sufficient to provide anti-redeposition properties in the detergent composition.

2. The composition of claim 1 wherein said cellulose acetate polymeric anti-redeposition agent is water-insoluble and is characterized as having a degree of substitution of the acetyl moiety of from above about 0.9 to about 2.3.

3. The composition of claim 1, wherein at least about 0.2 percent by weight of the anti-redeposition agent is provided in said detergent composition.

4. The detergent composition of claim 1, wherein said detergent component is selected from anionic, nonionic, ampholytic and zwitterionic detergents.

5. A built solid laundry detergent composition comprising from about 5 percent by weight to about 50 percent by weight of detergent compound selected from anionic and nonionic detergents, from about 90 percent to about 50 percent of a detergent builder component selected from inorganic alkaline builder salts, organic sequestrant builder salts, and mixtures thereof, and a cellulose acetate polymeric antiredeposition agent being characterized as having a degree of substitution of the acetyl moiety of from about 0.5 to about 2.3 and represented by the formula

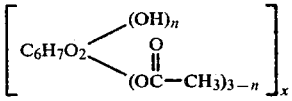

wherein x is an integer of at least about 25, n is about 2.5 to about 0.7, and the expression 3−n is the degree of substitution of the acetyl moiety, said anti-redeposition agent being provided in said detergent composition in an amount sufficient to provide anti-redeposition properties in the detergent composition.

6. A built liquid laundry detergent composition which comprises from about 5 percent to about 40 percent by weight of a detergent component selected from anionic and nonionic detergents, from about 90 percent to about 55 percent of a water-soluble detergent builder selected from inorganic alkaline builder salts, organic sequestrant builder salts, and mixtures thereof, a liquid vehicle selected from water, alcohol and mixtures thereof, and a cellulose acetate polymeric anti-redeposition agent being characterized as having a degree of substitution of the acetyl moiety of from about 0.5 to about 2.3 and represented by the formula

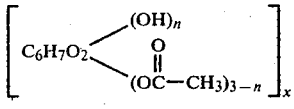

wherein x is an integer of at least about 25, n is about 2.5 to about 0.7, and the expression 3−n is the degree of substitution of the acetyl moiety, said anti-redeposition agent being provided in said detergent composition in an amount sufficient to provide anti-redeposition properties in the detergent composition.

7. A nonbuilt liquid laundry detergent composition comprising an aqueous solution of from about 30 percent to about 40 percent by weight of a nonionic detergent compound and about 10 percent to about 15 percent of an anionic detergent, and a cellulose acetate polymeric anti-redeposition agent being characterized as having a degree of substitution of the acetyl moiety of from about 0.5 to about 2.3 and represented by the formula

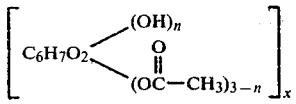

wherein x is an integer of at least about 25, n is about 2.5 to about 0.7, and the expression 3−n is the degree of substitution of the acetyl moiety, said anti-redeposition agent being provided in said detergent composition in an amount sufficient to provide anti-redeposition properties in the detergent composition.

* * * * *

UNITED STATES PATENT OFFICE

CERTIFICATE OF CORRECTION

Patent No. 4,235,735 Dated November 25, 1980

Inventor(s) Francis W. Marco and Philip G. Harris

It is certified that error appears in the above-identified patent and that said Letters Patent are hereby corrected as shown below:

Column 3, line 56, the word "actice" should be --active--.

Column 5, line 46, after the word "above" insert the word --detergent--.

Column 7, line 32, the word "antiredeposition" should be --anti-redeposition--.

Signed and Sealed this

Third Day of March 1981

[SEAL]

Attest:

RENE D. TEGTMEYER

Attesting Officer

Acting Commissioner of Patents and Trademarks